United States Patent [19]

Ohno

[11] Patent Number: 4,605,056

[45] Date of Patent: Aug. 12, 1986

[54] PROCESS AND APPARATUS FOR THE HORIZONTAL CONTINUOUS CASTING OF A METAL MOLDING

[75] Inventor: Atsumi Ohno, Chofu, Japan

[73] Assignees: Nippon Light Metal Company Limited; O.C.C. Company Limited, both of Tokyo, Japan

[21] Appl. No.: 620,019

[22] Filed: Jun. 13, 1984

[30] Foreign Application Priority Data

Jun. 13, 1983 [JP] Japan ..... 58-104248

[51] Int. Cl.[4] ..... B22D 11/00

[52] U.S. Cl. ..... 164/490; 164/440

[58] Field of Search ..... 164/462, 484, 485, 486, 164/490, 492, 418, 459, 505, 338.1, 507, 423, 425, 440, 480, 455, 250.1

[56] References Cited

U.S. PATENT DOCUMENTS

| | | | |
|---|---|---|---|
| 3,450,188 | 6/1969 | Vallak et al. | 164/485 |
| 3,628,596 | 12/1971 | Easton et al. | 164/490 |

FOREIGN PATENT DOCUMENTS

| | | | |
|---|---|---|---|
| 54-150323 | 11/1979 | Japan | 164/418 |
| 55-24709 | 2/1980 | Japan | 164/455 |
| 55-46265 | 11/1980 | Japan . | |
| 57-28655 | 2/1982 | Japan | 164/459 |
| 407630 | 4/1974 | U.S.S.R. | 164/82 |
| 923724 | 4/1982 | U.S.S.R. | 164/338.1 |

*Primary Examiner*—Nicholas P. Godici
*Assistant Examiner*—G. M. Reid
*Attorney, Agent, or Firm*—William J. Daniel

[57] ABSTRACT

In a continuous casting process, molten metal is supplied into a generally open top horizontal mold having an inner wall maintained at a temperature which is higher than the solidification temperature of the molten metal, while the molten metal is maintained under generally zero pressure at the outlet opening of the mold. A dummy bar is drawn horizontally away from the outlet opening of the mold to cause the molten metal to be drawn out of the mold opening and undergo solidification at the surfaces thereof directly proximate to the outlet opening. The exposed surface of the molten metal in the mold is heated through the open mold top by a heater spaced out of contact with the molten metal surface.

8 Claims, 5 Drawing Figures

PROCESS AND APPARATUS FOR THE HORIZONTAL CONTINUOUS CASTING OF A METAL MOLDING

BACKGROUND OF THE INVENTION

1. Field of the Invention:

This invention relates to a process and an apparatus for the horizontal continuous casting of a metal molding having a small thickness or diameter.

2. Description of the Prior Art:

There is known a continuous casting process which employs a cooling mold having a horizontally extending cavity. Molten metal is supplied into the mold at one end thereof and solidified therein, and the slab or ingot thereby produced is drawn out through the opposite end of the mold continuously in a horizontal direction. This process is widely used for the production of ferroalloy and nonferrous alloy moldings. The molten metal supplied into the mold forms a solid skin along the inner surface of the mold, and the unsolidified metal surrounded by the solid skin is completely solidified by secondary cooling outside the mold. The process has, therefore, the disadvantage of impurities becoming concentrated in the last portion of the slab or ingot to be solifided, and gives rise to defects, such as segregation and blowholes, therein. Another drawback of this process is due to the fact that the slab (or ingot) is drawn out of the mold intermittently after the solid skin has grown to a sufficient thickness to prevent the cracking of the slab surface and the breakout of the molten metal which are likely to occur as a result of the friction developed between the mold and slab surfaces when the slab is drawn out of the mold. This intermittent operation, however, results in the formation of oscillation marks which are likely to cause the cracking of the slab when it is subjected to plastic deformation working. It is, therefore, necessary to remove the surface defects of the slab by, for example, grinding, scalping or melting prior to its plastic deformation working. In the event the slab is of a material having a wide solidification temperature range, such as cast iron or phosphor bronze, it is impossible to avoid the breakout of the molten metal unless the slab is drawn out after the molten metal has been completely solidified in the mold.

The inventor of this invention previously proposed an improved continuous casting process for producing metal molded structure having a smooth surface free from any surface defect formed by the friction between the mold and the slab to be cast therein. According to this process, the inner wall of a hollow mold in the vicinity of its outlet opening is heated by an embedded heater and thereby maintained at a temperature above the solidification temperature of the metal to be cast, so that the molten metal supplied from a molten metal holding furnace does not form a solid skin on the inner wall of the mold, but form a slab surface beginning to solidify immediately outwardly of the outlet of the mold. This process enables the continuous casting of an elongated slab having a smooth surface and a unidirectionally solidified structure. This process is disclosed in Japanese Patent Publication No. 46265/80 published on Nov. 21, 1980.

The inventor has thought of applying this process to the horizontal continuous casting of a molded metal structures. It has, however, been found difficult to produce such a structure free of blowholes, since the gas released from the molten metal during its solidification is prevented by the top wall of the mold from escaping out into the ambient air. Moreover, as the solidification of the slab surface takes place in the vicinity of the outlet of the mold, even a slight change in mold temperature, cooling water temperature or casting rate is likely to cause the molten metal to break out through the outlet of the mold. In order to avoid such breakout, it is imperative to be precisely aware of the position and configuration of the boundary between the solidified metal and the unsolidified metal in the mold.

SUMMARY OF THE INVENTION

It is an object of this invention to provide an improved process which enables the horizontal continuous casting of a molded metal structure in the shape of a sheet or wire rod without any confinement of the gas released from the molten metal during its solidification, or any breakout of the molten metal.

It is another object of this invention to provide an improved apparatus for the horizontal continuous casting of a molded structures in the shape of a sheet or wire rod.

These objects are essentially attained by the use of a horizontally disposed, generally trough-shaped mold having an open top. The use of a mold having an open top permits a the correct detection of the position of the boundary between the solidified metal and the unsolidified metal. Therefore, if the casting rate and the mold temperature are appropriately controlled, it is possible to minimize the possibility of breakout of the molten metal and achieve a high degree of safety in the continuous casting operation. As the mold has an open top, any gas released from the molten metal during its solidification is readily dissipated from the molten metal surface to the ambient air. It is, therefore, possible to produce a beautiful metal molding having a unidirectionally solidified structure free of any blowhole.

The mold is mounted in the sidewall of a molten metal holding furnace immediately below the surface of the molten metal therein. A dummy bar has one end disposed in the mold. The molten metal is introduced into the mold and brought into contact with an adjacent end of the dummy bar. The dummy bar is drawn out of the mold to draw out a molded structure, while it is cooled by an appropriate device outside the mold. A heater is embedded in the mold to heat its inner wall and hold it at a temperature which is higher than the solidification temperature of the molten metal, so that the molded structure does not start solidifying on the inner wall of the mold, but begins to solidify at its leading end adjacent to the end of the dummy bar.

The mold may have a single cavity to produce a single structure, or a plurality of cavities to produce the same plurality of structures at a time.

This invention is particularly suitable for the continuous casting of a thin sheet or wire rod which can be produced from a volume of molten metal which does not exert a very large pressure on the bottom of the mold. In order to produce a sheet or wire rod having a completely unidirectionally solidified structure, it is necessary to prevent the cooling of the molten metal surface by the ambient air. This requirement is satisfied if an electric resistance heater spaced apart from the molten metal is provided above the mold to heat the molten metal surface, or if the molten metal surface is heated by a gas burner fired with a combustible gas, such as carbon monoxide or a carbohydrate.

DETAILED DESCRIPTION OF THE INVENTION

Figure 1:
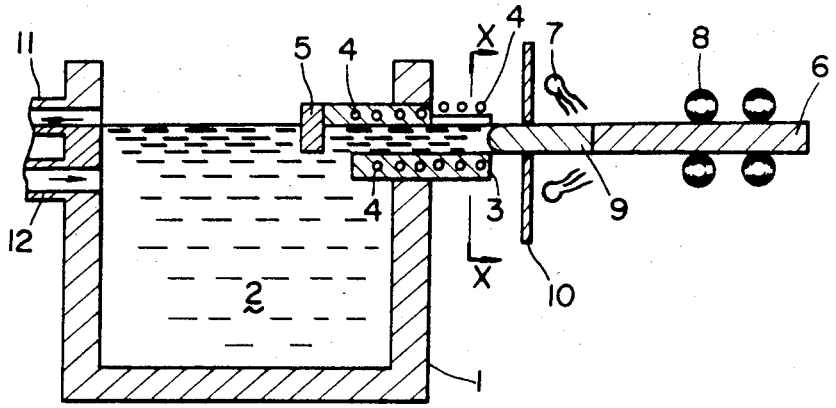
FIG. 1 is a front elevational view, partly in section, of a horizontal continuous casting apparatus embodying this invention.

A horizontal continuous casting apparatus embodying this invention is shown in FIG. 1, and includes a molten metal holding furnace 1. The furnace 1 holds a bath of molten metal 2, and has an overflow port 11 through which any excess of molten metal flows out to maintain a constant level in the furnace 1. A mold 3 is mounted in the sidewall of the furnace 1, and has a bottom located at a level so spaced below the surface of the molten metal 2 in the furnace 1 the distance needed to ensure the production of a sheet or wire rod having a predetermined size. The mold 3 has an open top. An electric resistance heater 4 is embedded in the mold 3 to generate heat upon application thereto of an electric current through an ordinary power supply device including lead wires. The heater 4 has an exposed portion extending over the open top of the mold 3 to heat the surface of the molten metal in the mold 3. The mold 3 is provided at its inlet with a barrier ordam 5 having a lower end disposed in the molten metal 2 to prevent any oxide film from entering the mold 3.

A dummy bar has one end disposed in the outlet opening of the mold 3. The molten metal 2 flowing into the mold 3 contacts the end of the dummy bar and begins to solidify thereat. The dummy 6 is drawn horizontally away from the mold 3 by pinch rolls 8 to draw out a solidified metal structure 9. The structure 9 is cooled by a cooling medium, such as air, gas, mist or water, which is supplied by a spraying device 7. If the metal is cooled at too high a rate, the trailing end of the solidified molded structure extends into the mold 3. The inner wall of the mold 3 is, therefore, heated by the heater 4 so that the metal does not solidify within the inner wall of the mold 3, and so that the molding 9 may be drawn out without causing any friction with the inner wall of the mold 3. A plate 10 for shielding the radiation of heat is provided between the mold 3 and the cooling device 7. The molten metal is supplied into the furnace 1 through a port 12 located below the overflow port 11.

Figure 2:
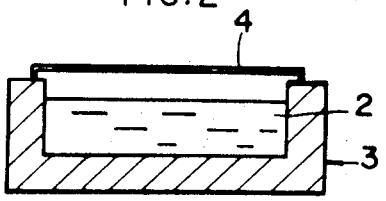
FIG. 2 is a sectional view taken along the line X—X of FIG. 1 where the apparatus is designed to produce a sheet.

According to a salient feature of this invention, the mold 3 may be embodied in various configurations. FIG. 2 shows a mold 3 designed to produce a metal sheet. The heater 4 extending over the open top of the mold 3 heats the surface of the molten metal 2 to maintain it at a temperature above the solidification temperature of the metal so that the gas released from the molten metal 2 during its solidification may easily escape into the ambient air through the open top of the mold 3.

Figure 3:
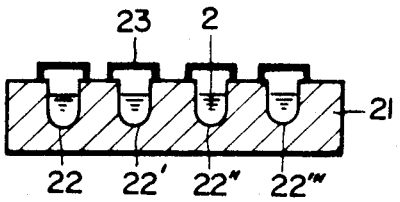
FIG. 3 is a sectional view taken along the line X—X of FIG. 1 in the event the apparatus is designed to produce a plurality of wire rods.

The mold shown in FIG. 3 is designed to produce simultaneously a plurality of wire rods. The mold 21 has a plurality of substantially parallel trough-shaped cavities 22, 22', 22'' and 22''' each having a generally U-shaped cross section. In addition to an embedded heater, the mold 21 is provided with a plurality of electric resistance heaters 23 each disposed above the open top of one of the cavities.

Figure 4:
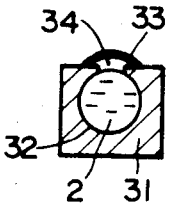
FIG. 4 is a cross sectional view of another mold designed to produce a wire rod having a circular cross section.

FIG. 4 shows a mold 31 having an embedded heater and designed to produce a wire rod having a circular cross section. The mold 31 has a cavity 32 having a generally C-shaped cross section defining an open top, and an electric resistance heater 33 extending over the open top of the cavity 32. The open top 34 of the cavity 32 is sufficiently small in width to enable the molding of a wire rod having substantially a circular cross section.

Figure 5:
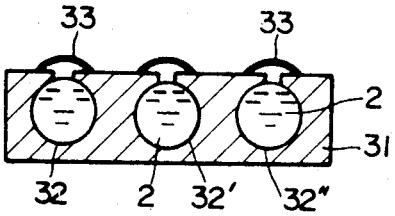
FIG. 5 is a cross sectional view of still another mold designed to produce simultaneously a plurality of round wire rods.

A modification of the mold shown in FIG. 4 is shown at 31 in FIG. 5, and designed to produce simultaneously a plurality of wire rods having a circular cross section. The mold 31 has a plurality of substantially parallel cavities 32, 32' and 32'' each having a generally C-shaped cross section, and an electric resistance heater 33 lying above the open top of each cavity, in addition to an embedded heater.

According to this invention, it is preferable to select the construction material and wall thickness of the mold in the light of the metal to be molded, so that the inner wall of the mold may be easily maintained at a temperature above the solidification temperature of the metal. A graphite mold may, for example, be suitable for molding an alloy having a low solidification temperature, such as an aluminum or copper alloy, while a mold formed from a refractory material consisting mainly of, for example, alumina, silica, beryllia, magnesia, thoria, zirconia, boron nitride, silicon carbide or silicon nitride can be best used for molding steel, cast iron or an alloy having a high melting point. It is, of course, important to choose a material which does not react with, or be corroded by, the molten metal to be molded. It is also advisable to maintain an inert or reducing atmosphere over the surface of the molten metal in the mold to prevent its oxidation.

This invention is an improvement over the conventional continuous casting process in that it enables the continuous production of a metal molded structure in the shape of a sheet or wire rod having a smooth crack-free surface and a unidirectionally solidified structure substantially free from any blowhole. While a sheet or wire rod has hitherto been molded from a slab or ingot by repeated plastic deformation working and heat treatment, this invention enables the direct molding of a sheet or wire rod from the molten metal, and is, therefore, an important improvement in the saving of energy and labor, too. This invention enables the formation of a virtually infinitely extending columnar structure of welded metal or alloy, and is, therefore, very useful for the continuous casting of an electromagnetic material or a very fine wire for electric conduction which is required to have a unidirectionally solidified structure.

The invention will now be described more specifically with reference to several examples thereof.

EXAMPLE 1

A silicon carbide mold of the construction shown in FIG. 2, and having a cavity height of 5 mm, a cavity width of 20 mm and a wall thickness of 10 mm was mounted on a molten metal holding furnace of the type shown in FIG. 1. Molten aluminum of 99.9% purity having a temperature of 700° C. was supplied into the furnace, and the surface of the molten metal was maintained at a level of 3 mm above the bottom of the cavity in the mold. The mold was held at a temperature of 680° C., and the molten metal was continuously supplied into the mold. A dummy bar was drawn out horizontally at a speed of 60 mm per minute, while cooling water was sprayed onto the outcoming molding at a rate of 600 cc per minute by a spray device situated at a distance of 50 mm from the outlet of the mold. There was obtained a continuous aluminum sheet having a thickness of 3 mm and a width of 20 mm, and a smooth surface free from any blowholes.

EXAMPLE 2

A graphite mold of the construction shown in FIG. 4, and having an inside diameter of 6 mm and an open top width of 3 mm was mounted in the apparatus shown in FIG. 1. Molten tin of 99.9% purity having a temperature of 250° C. was supplied into the holding furnace, and the surface of the molten metal was maintained immediately below the open top of the mold. The mold was held at a temperature of 233° C., and the molten metal was continuously supplied into the mold. A dummy bar was drawn out horizontally at a speed of 200 mm per minute, while cooling water was sprayed onto the outcoming molding at a rate of 150 cc per minute by a device situated at a distance of 20 mm from the outlet of the mold. There was continuously obtained a 6 mm dia. wire having a smooth surface and a unidirectionally solidified structure free from any blowholes.

What is claimed is:

1. A continuous casting process comprising: supplying molten metal into a generally open top horizontal mold having an inner wall maintained at a temperature above the solidification temperature of said metal, while maintaining said molten metal under a substantially zero pressure at the outlet opening of said mold; applying heat to the exposed surface of the molten metal in said mold through the open top of said mold by heater means spaced out of contact with said molten metal surface to maintain said surface above the solidification temperature of said metal; and drawing a dummy bar horizontally away from said outlet opening to cause said molten metal to solidify continuously after exiting the mold to form the leading end of a molded product.

2. A process as set forth in claim 1, wherein said heating means is an electric resistance heater.

3. A process as set forth in claim 1, wherein said mold has an open cavity having a generally U-shaped vertical cross section.

4. A process as set forth in claim 1, wherein said mold has an open cavity having a generally C-shaped cross section.

5. A continuous casting apparatus comprising: a horizontal mold provided with at least one cavity defined by at least one inner wall and having an open top, an inlet opening and an outlet opening; means for supplying molten metal into said mold under generally zero pressure at said outlet opening; means for maintaining each said inner mold wall at a temperature which is higher than the solidification temperature of said molten metal; heating means spaced above and out of contact with the upper surface of the molten metal in said mold for applying heat therto through said open mold top to maintain said surface above the solidification temperature of said metal; a dummy bar having one end disposed in said outlet opening; means for drawing out said dummy bar horizontally to draw out a molded product horiziontally from said mold opening; and means for continuously initiating soldification of the surfaces of said molded product after exiting the outlet opening of said mold and such surfaces leave the heated inner wall of said mold cavity.

6. An apparatus as set forth in claim 5, wherein said heater is an electric resistance heater.

7. An apparatus as set forth in claim 5, wherein said cavity has a generally U-shaped cross section.

8. An apparatus as set forth in claim 5, wherein said cavity has a generally C-shaped cross section.

* * * * *